United States Patent [19]

Ejdenwik

[11] Patent Number: 4,987,805

[45] Date of Patent: Jan. 29, 1991

[54] ADJUSTABLE EYEBOLT KEY

[75] Inventor: Eugen E. Ejdenwik, Eskilstuna, Sweden

[73] Assignee: Noren & Persson AB, Strangnas, Sweden

[21] Appl. No.: 415,902

[22] Filed: Oct. 2, 1989

[51] Int. Cl.[5] ..... B25B 13/14

[52] U.S. Cl. ..... 81/77; 81/155

[58] Field of Search ..... 81/77, 129, 129.5, 165–170, 81/155

[56] References Cited

U.S. PATENT DOCUMENTS 717,390 12/1902 Gray ..... 81/77

4,374,480 2/1983 Diaz ..... 81/57.3

FOREIGN PATENT DOCUMENTS 643428 4/1928 France ..... 81/166

*Primary Examiner*—D. S. Meislin

*Attorney, Agent, or Firm*—Burgess, Ryan & Wayne

[57] ABSTRACT

An adjustable eyebolt key includes a flat stem element having side limiting bars extending along the length thereof, an underside center section of a lesser thickness connecting the side limiting bars and which defines a recess therein and two key rings at opposite ends thereof; a tongue slidably positioned in the recess on the upper surface of the underside center section, with the ends of the tongue having the same thickness as the key ring within which it is slidable so as to adjust the grip of each key ring; a worm rotatably secured on the stem element for engagement with gear teeth at an edge of the tongue for actuating the tongue to move along the stem element so as to adjust the grip of each key ring; and a cross-tie in the vicinity of each key ring which secures the tongue on the stem element so as to permit movement of the tongue along the stem element.

3 Claims, 1 Drawing Sheet

ADJUSTABLE EYEBOLT KEY

BACKGROUND OF THE INVENTION

The invention relates to an adjustable eyebolt key.

In a ring wrench of a known adjustable eyebolt key, the tongue is held on the stem element by pins which prominently project from the tongue through a slot in the stem element and are supported with their heads on the rear side thereof. Different problems result in this known design. For example, when loosening screws that are very firmly lodged, the tongue breaks away slightly upwardly and perpendicular to its surface. This problem is particularly hard to avoid when the screw spanner is not quite correctly superposed on the screw or is actuated perpendicular to the direction of the screw when it is handled. Further, the force applicable to a nut to be loosened or tightened is relatively weak, since the tongue is designed very flat, that is, of a smaller width than the remainder of the tool, so that the tongue grips the nut in an equally flat or narrow area. If a stronger force is applied, the nut is destroyed.

OBJECTS AND SUMMARY OF THE INVENTION

Departing from the above cited prior art, the problem to be solved by the invention is to develop an adjustable eyebolt key of the type mentioned in the sense of enlarging the applicable forces that can be applied and improving the handling thereof.

This problem is solved by the fact that the tongue is movably held on the stem element in the area of the key ring by a cross-tie. This manner of fastening ensures that the tongue is effectively secured precisely at the place on which the strongest force acts perpendicular to its flat side, and thus, it cannot break off upwardly.

The tongue preferably has, on its end insertable in the key ring, a thickened area of a thickness that corresponds to that of the key ring. This feature ensures that the grip surface of the key ring and tongue be equally large so that damage to the nut only occurs (if at all) in case of substantially stronger forces.

In a preferred embodiment of the invention, key rings of different extensions of grip are provided at both ends of the stem element so that the whole arrangement covers an additional area of adjustment without the necessity of using a very narrow tongue. In this case, cross-ties are provided at both ends of the stem element.

The manufacture of the eyebolt key can be simplified and the durability improved by the fact that one of the two cross-ties is solidly welded on the stem element, while the other cross-tie can be subsequently secured to the stem element. It is particularly advantageous for fastening if this latter cross-tie is held by a pin at one end with the stem element and pivotably parallel with the upper surface of the stem element and parallel with the surface of the tongue, while a screw serves for fastening the other end. For assembling this arrangement, after pivoting this one cross-tie, the tongue is pushed under the firmly secured cross-tie, placed flat on the stem element, and finally, the other cross-tie is pivoted back and screwed on.

The eyebolt key is then particularly easy to manipulate and is similar to a conventional eyebolt key with regard to use, when its rear side is designed with a plane surface. In addition, the manipulability of the arrangement with a key ring at each end is improved by placing the worm drive at the center of the stem element. The "grip feeling" is then particularly good.

A bore for lubrication and cleaning is preferably provided in the tongue and/or in the stem element. According to the intended use, which entails a light soiling, this is particularly advantageous, particularly in combination with the kind of support of the tongue on the stem element. It has actually been demonstrated that the adjustable eyebolt key already known, very quickly becomes soiled to such an extent that its adjustability is considerably impaired. This is not the case with the eyebolt key according to the invention.

BRIEF DESCRIPTION OF THE DRAWINGS

Other details essential to the invention result from the description that follows of a preferred embodiment of the invention which is explained in further detail with reference to the drawing in which.

DETAILED DESCRIPTION OF A PREFERRED EMBODIMENT

Figure 1:
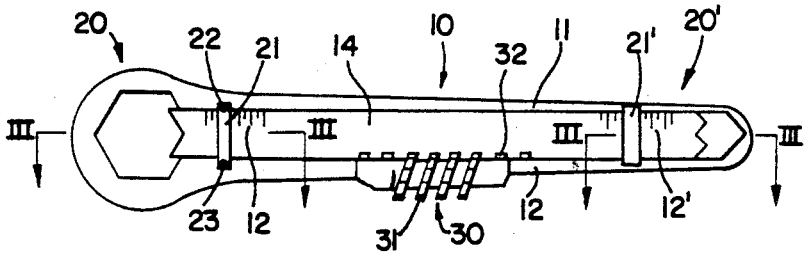
FIG. 1 is a top view of an eyebolt key according to the invention.
Figure 2:
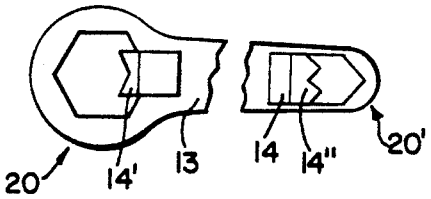
FIG. 2 is a partial bottom view thereof.

Referring to the drawings in detail, an adjustable eyebolt key includes a flat stem element 10 having an underside center section 13 joined at opposite edges by side limiting bars 11 and 12 which extend over its whole length and which define a groove or recess therebetween. On both ends of the stem element 10 there are formed key rings 20, 20', both key rings 20, 20' having different dimensions.

A tongue 14 is supported in the recess in the stem element 10. The tongue 14 has end sections shaped in a manner such that in the position drawn to the extreme right in FIG. 1, it continues the contour of the larger key ring 20, while in the position moved entirely to the left (in FIG. 1), it defines the largest adjustable opening of the smaller key ring 20'.

For adjusting the tongue 14, a worm drive 30 includes a worm 31 rotatably supported on limiting bar 12 or the underside center section 13 of the stem element 10, at the center thereof, and which meshes with gear teeth 32 of tongue 14. The tongue 14 can thus be moved to the right or left over the worm 31 of worm drive 30.

In the area of key rings 20, 20' cross-ties 21, and 21' are respectively secured on limiting bars 11, 12 so as to cover and secure tongue 14. The cross-tie 21' is firmly welded to limiting bars 11 and 12, while the other cross-tie 21 is fixed on one end to limiting bar 11 by a pin 22 and on the other end to limiting bar 12 by a detachable screw 23. The pin 22 is designed in a manner such that the cross-tie 21, after loosening of the screw 23, can be swung out. Thus, tongue 14 can be drawn out transversely from under the other cross-tie 21'. On both ends of the tongue 14, there are provided marks 17, 17' which, according to their position relative to the cross-tie 21 or 21', indicate the precisely adjusted spanner opening.

Figure 3:
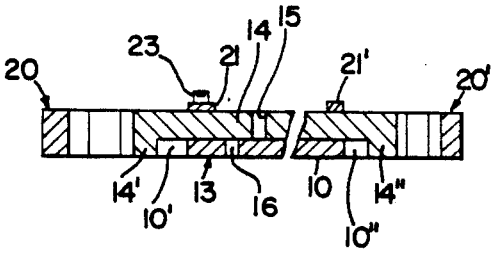
FIG. 3 is a partial section of the eyebolt key, taken along lines III—III of FIG. 1.

The tongue 14 has a thickened area 14', 14'' at each respective end which projects downwardly from the tongue 14 at opposite ends of underside center section 13 and which has a thickness corresponding to that of the key ring 20, 20' as shown in FIG. 3. Accordingly, a recess 10', 10'' is provided at opposite ends of underside center section 13 of the stem element 10 so as to receive thickened areas 14, 14'', whereby tongue 14 is slidably guided beneath the corresponding cross-ties 21, 21' on the upper planar surface of underside center section 13.

A bore is provided in tongue 14 for lubrication and cleaning, and, in like manner, in the underside center section 13 of the stem element 10, there is also provided a bore 16 for lubrication.

As a result of the foregoing, three features are important to the invention: on one hand, the holding of the tongue 14 transversely to its lengthwise upper surface by the cross-ties 21, 21', and on the other hand, the formation of a thickened area 14', 14'' at the ends of the tongue 14. Finally, the total design of the screw spanner with its flat underside center section 13 and the central position of the adjusting worm 31 for improving the handling is important, since only a screw spanner so designed imparts a comfortable feeling to the user.

What is claimed is:

1. An adjustable eyebolt key comprising:

a flat stem element having a first end with a first key ring thereat, and a second, opposite end with a second key ring thereat, said first and second key rings having different gripping dimensions, said stem element including side limiting bars extending along a length thereof and an underside center section connecting said side limiting bars and having a thickness less than that of said limiting bars so as to define a recess between an upper planar surface of said underside center section and upper surfaces of said limiting bars, a tongue means for cooperation with said key rings to grip a workpiece and being slidable and guided on along the upper surface of said underside center section; at least one of said tongue means and said stem element includes a bore for lubrication and cleaning;

worm drive means on said stem element for actuating said tongue means to move along said stem elements such that said tongue means selectively extends into and retracts out of said key rings so as to adjust the grip of each of said key rings; and cross-tie means including a first cross-tie fixedly attached to the stem element and overlying said tongue means to secure said tongue means on said stem element and a second cross-tie pivotally attached to the stem element and overlying said tongue means to removably secure said tongue means on said stem element.

2. An adjustable eyebolt key according to claim 1, wherein said tongue means has opposite ends, at least one said end insertable in a respective said key ring, each said end having a thickened area of a thickness corresponding to that of the respective key ring so as to provide a total gripping surface with said end and said key ring which is of substantially uniform width.

3. An adjustable eyebolt key according to claim 1, wherein said tongue means includes gear teeth along an edge thereof and said worm drive means includes a worm rotatably fixed at a center portion of said stem element for engagement with the gear teeth on said tongue means.

* * * * *